US008596842B2

(12) United States Patent
Lee

(10) Patent No.: US 8,596,842 B2
(45) Date of Patent: Dec. 3, 2013

(54) HEAD LAMP FOR VEHICLE

(75) Inventor: Jae Hun Lee, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 212 days.

(21) Appl. No.: 13/172,650

(22) Filed: Jun. 29, 2011

(65) Prior Publication Data

US 2012/0134168 A1 May 31, 2012

(30) Foreign Application Priority Data

Nov. 10, 2010 (KR) ..... 10-2010-0111694

(51) Int. Cl.
*F21V 7/09* (2006.01)
*F21V 7/00* (2006.01)

(52) U.S. Cl.
USPC ..... 362/518; 362/516; 362/517

(58) Field of Classification Search
USPC ..... 362/509–522
See application file for complete search history.

(56) References Cited

U.S. PATENT DOCUMENTS

| | | | | |
|---|---|---|---|---|
| 7,175,322 | B2 * | 2/2007 | Tanaka | 362/517 |
| 2009/0067186 | A1 * | 3/2009 | Futami | 362/516 |

FOREIGN PATENT DOCUMENTS

| | | | |
|---|---|---|---|
| JP | 2002-358806 | A | 12/2002 |
| KR | 0132561 | Y1 | 12/1998 |
| KR | 0139526 | Y1 | 4/1999 |
| KR | 10-0839701 | B1 | 6/2008 |
| KR | 10-2010-0011694 | A | 2/2010 |

* cited by examiner

*Primary Examiner* — Karabi Guharay
*Assistant Examiner* — Nathaniel Lee
(74) *Attorney, Agent, or Firm* — Morgan, Lewis & Bockius LLP

(57) ABSTRACT

A head lamp apparatus for a vehicle may include a reflector provided with a light source that emits light to reflect the light emitted from the light source in a forward direction, the reflector having an upper end at which a first auxiliary reflective surface may be formed, and a lower end at which a second auxiliary reflective surface may be formed, and a bezel mounted in front of the reflector and having an upper part on which a first reflective hole that corresponds to the first auxiliary reflective surface may be formed, and a lower part on which a second reflective hole that corresponds to the second auxiliary reflective surface may be formed.

3 Claims, 3 Drawing Sheets

HEAD LAMP FOR VEHICLE

CROSS-REFERENCE TO RELATED APPLICATION

The present application claims priority to Korean Patent Application No. 10-2010-0111694, filed on Nov. 10, 2010 in the Korean Intellectual Property Office, the entire contents of which is incorporated herein for all purposes by this reference.

BACKGROUND OF THE INVENTION

1. Field of the Invention

The present invention relates to a head lamp for a vehicle, and more particularly, to a head lamp for a vehicle, which can improve a luminescent image of the head lamp that is irradiated onto a road surface.

2. Description of Related Art

In general, a head lamp for a vehicle is composed of a projection unit installed in a housing inside the vehicle and an outer lens coupled to an outside of a projection unit.

The projection unit is composed of a reflector on which a bulb is installed and an aspherical lens provided in front of the reflector to irradiate light. In the recent vehicle market, it has become necessary to captivate the sensitivity of consumers from a design standpoint in addition to insurance of a high technical level from a marketing standpoint.

In the same manner, outer lenses having diverse designs have been adopted in the head lamp, and such head lamp designs become inherent shapes of vehicle makers to play great role in merchantability.

As described above, the design of the head lamp and the design of a tail lamp exert a great influence on the design of the vehicle, and an example thereof may be a luminescent line that emits light in the neighborhood of the aspherical lens of the head lamp.

The luminescent line forms the border of the aspherical lens with a color that is different from a color of a general bulb light. The luminescent line not only passes the border of the aspherical lens but also puts around the whole head lamp to reflect the inherent shapes of the makers.

That is, recent head lamps not only serve as luminescent devices but also have been developed from a design standpoint.

In order to implement the luminescent line of the head lamp in the related art, the luminescent line is installed along the border of the aspherical lens, and light emitted from a separate luminescent portion is collected, transferred through a cable or the like, and then supplied to the luminescent line to perform the luminescence around the aspherical lens.

However, in order to add a separate light source in the head lamp structure for a vehicle in the related art, additional constituent components are required, and this causes the weight and the price of the head lamp to be increased and the structure of the head lamp to be complicated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a head lamp for a vehicle, which can improve a luminescent image of the head lamp that is irradiated onto a road surface.

In one aspect of the present invention, the head lamp apparatus for a vehicle may include a reflector provided with a light source that emits light to reflect the light emitted from the light source in a forward direction, the reflector having an upper end at which a first auxiliary reflective surface may be formed, and a lower end at which a second auxiliary reflective surface may be formed, and a bezel mounted in front of the reflector and having an upper part on which a first reflective hole that corresponds to the first auxiliary reflective surface may be formed, and a lower part on which a second reflective hole that corresponds to the second auxiliary reflective surface may be formed.

The head lamp apparatus for the vehicle may further include an upper lens provided on the first auxiliary reflective surface to form the first reflective hole between the bezzel and the upper lens.

The head lamp apparatus for the vehicle may further include a lower lens provided on the second auxiliary reflective surface to form the second reflective hole between the bezzel and the lower lens.

The head lamp apparatus for the vehicle may further include a side lens provided on a side surface of the bezel.

The length of the second reflective hole between the bezzel and the lower lens may be larger than the length of the first reflective hole between the bezzel and the upper lens.

The first auxiliary reflective surface may be larger than the second auxiliary reflective surface.

With the above-described construction according to the present invention, the luminescent image of the head lamp is changed to improve merchantability, and the light width of the light of the head lamp that is irradiated onto the road surface is maximized to increase driver's visibility and to heighten safety.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
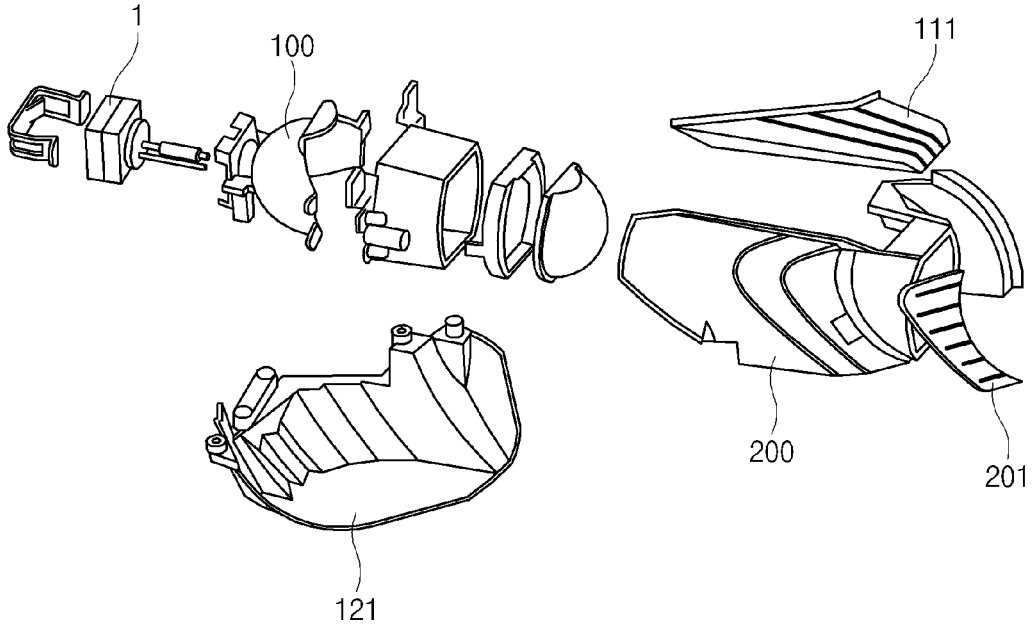
FIG. 1 is an exploded perspective view illustrating a head lamp for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described with reference to the accompanying drawings.

Figure 2:
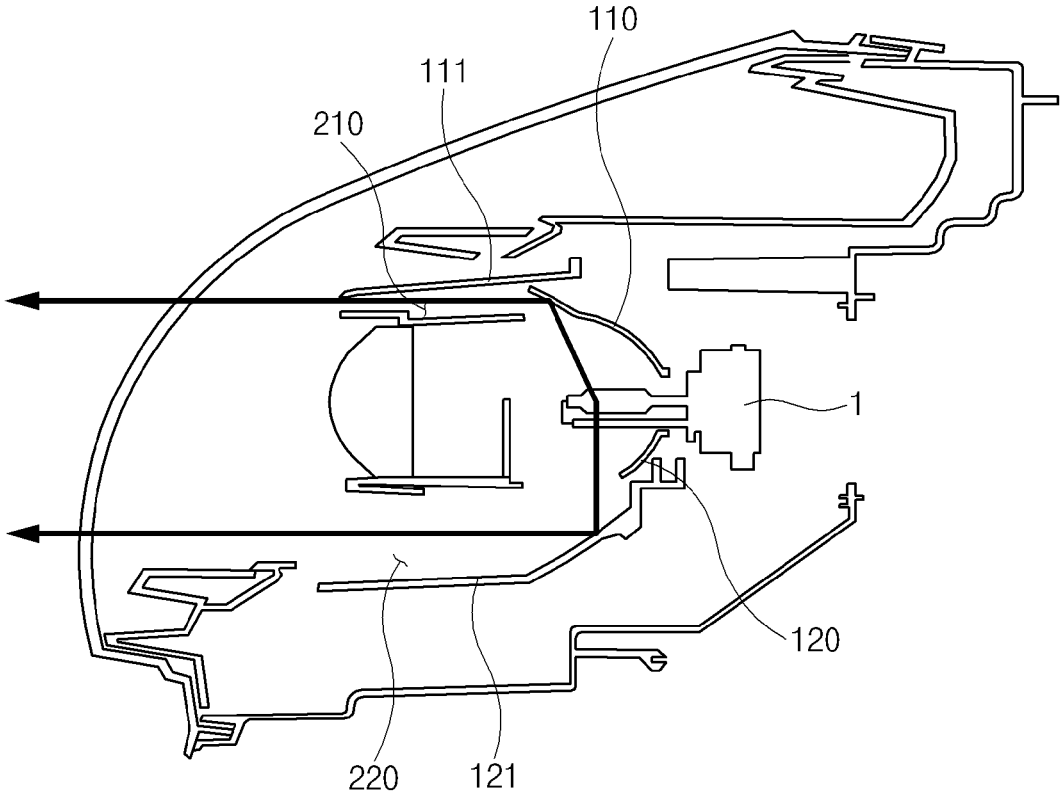
FIG. 2 is a cross-sectional view illustrating a head lamp for a vehicle according to an exemplary embodiment of the present invention.
Figure 3:
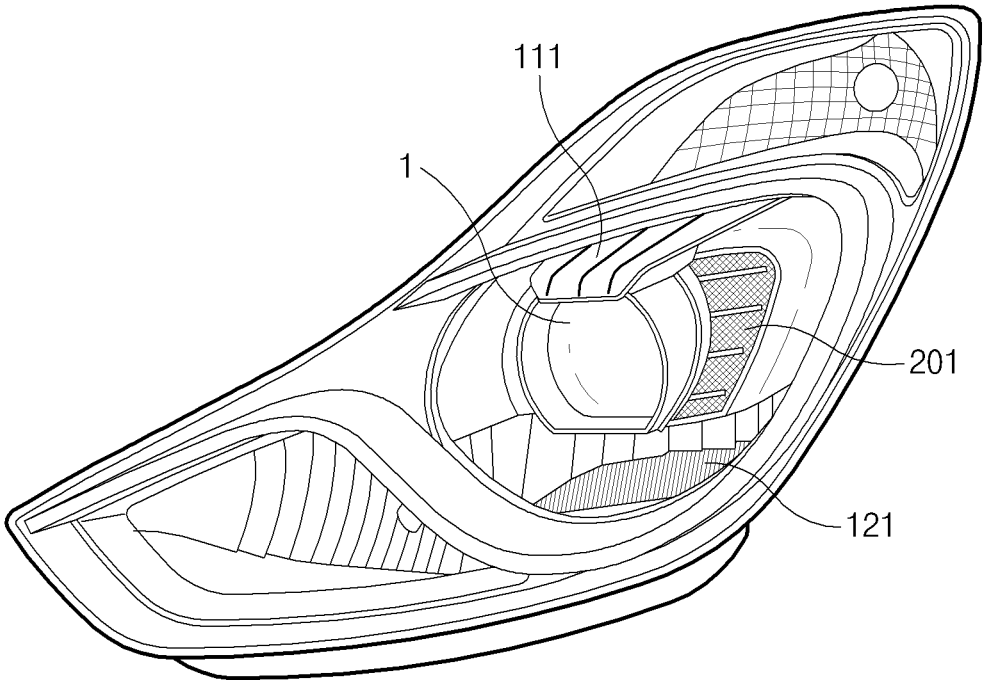
FIG. 3 is a view illustrating an example of a head lamp for a vehicle according to an exemplary embodiment of the present invention.

FIGS. 1 to 3 illustrate a head lamp for a vehicle according to an exemplary embodiment of the present invention. FIG. 1 is an exploded perspective view illustrating a head lamp for a vehicle according to an exemplary embodiment of the present invention, FIG. 2 is a cross-sectional view illustrating a head lamp for a vehicle according to an exemplary embodiment of the present invention, and FIG. 3 is a view illustrating an example of a head lamp for a vehicle according to an exemplary embodiment of the present invention.

A head lamp for a vehicle according to an exemplary embodiment of the invention, as illustrated in FIGS. 1 to 3, includes a reflector 100 reflecting light emitted from a light source 1 through a first auxiliary reflective surface 110 and a second auxiliary reflective surface 120, and a bezel 200 irradiating the reflected light to outside through a first auxiliary hole 210 and a second auxiliary hole 220, and changes a luminescent image of the head lamp through the plurality of reflective surfaces.

Hereinafter, respective constituent elements of a head lamp for a vehicle according to an exemplary embodiment of the present invention will be described in detail with reference to the accompanying drawings.

According to the head lamp for a vehicle according to an exemplary embodiment of the invention, the light emitted from the light source 1 is reflected through the reflector 100 and is irradiated to the outside.

As illustrated in FIGS. 1 and 2, the light source 1 that emits light is provided in the reflector 100, and the light emitted from the light source 1 is reflected in the forward direction through reflective surfaces formed inside the reflector 100.

In this case, the first auxiliary reflective surface 110 is formed at an upper end of the reflector 100, and the second auxiliary reflective surface 120 is formed at a lower end of the reflector 100. Accordingly, the light, which is emitted by the light source 1 in a single direction, is reflected in various directions by the plurality of reflective surfaces.

The bezel 200 is mounted on the reflector 100, and enables the light, which is emitted from the light source 1 and is reflected through the reflector 100, to be irradiated to outside.

Here, the first reflective hole 210 that corresponds to the first auxiliary reflective surface 110 is formed on the upper portion of the bezel 200, and the second reflective hole 220 that corresponds to the second auxiliary reflective surface 120 is formed on the lower portion of the bezel 200. Accordingly, the light reflected through the reflector 100 is divided into an upper light and a lower light to be irradiated.

On the other hand, as illustrated in FIG. 3, an upper lens 111 is additionally provided on the first auxiliary reflective surface 110 that is formed on the upper portion of the reflector 100 to improve the entire design of the head lamp and the luminescent image during light emission through the light source 1, and a lower lens 121 is additionally provided on the second auxiliary reflective surface 120 that is formed on the lower portion of the reflector 100 to widen the light width of the light that is irradiated onto the road surface.

Also, a side lens 201 is additionally provided on the side surface of the bezel 200 to improve visibility.

Hereinafter, the operation and the effect of the head lamp according to an exemplary embodiment of the present invention will be described.

As illustrated in FIGS. 1 and 2, the head lamp for a vehicle according to an exemplary embodiment of the invention includes the reflector 100 reflecting the light emitted from the light source 1 through the first auxiliary reflective surface 110 and the second auxiliary reflective surface 120, and the bezel 200 irradiating the reflected light to outside through the first auxiliary hole 210 and the second auxiliary hole 220, and thus the reflective directions of the head lamp can be increased.

On the other hand, the first auxiliary reflective surface 110 and the second auxiliary reflective surface 120, which are formed on the reflector 100, correspond to the first reflective hole 210 and the second reflective hole 220, which are formed on the bezel 200, and the light emitted from the light source 1 is reflected in upward and downward directions through the first reflective surfaces 110 and the second reflective surface 120 of the reflector 100 and the first reflective hole 210 and the second reflective hole 220 of the bezel 200 to improve the luminescent effects of the head lamp.

According to the head lamp for a vehicle, as illustrated in FIG. 3, the design of the head lamp and the luminescent image can be improved while the light is emitted through the upper lens 111 provided on the first auxiliary reflective surface 110 of the reflector 100. Also, the light width of the light, which is irradiated onto the road surface, is widened through the lower lens provided on the second auxiliary reflective surface 120 provided in the reflector 100, and thus the lower lens 121 can improve the driver's visibility, together with the side lens 201 provided on the side surface of the bezel 200.

As described above, according to an exemplary embodiment of the present invention, the head lamp includes the reflector provided with the light source that emits light to reflect the light emitted from the light source in the forward direction, the first auxiliary reflective surface formed at the upper end thereof, and the second auxiliary reflective surface formed at the lower end thereof, and the bezel mounted on the reflector and having the upper part on which the first reflective hole corresponding to the first auxiliary reflective surface is formed and the lower part on which the second reflective hole corresponding to the second auxiliary reflective surface is formed. Accordingly, the luminescent image of the head lamp is changed to improve merchantability, and the light width of the light of the head lamp that is irradiated onto the road surface is maximized to increase driver's visibility and to heighten safety.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof.

It is intended that the scope of the invention be defined by the Claims appended hereto and their equivalents.

What is claimed is:

1. A head lamp apparatus for a vehicle comprising:

a reflector provided with a light source that emits light to reflect the light emitted from the light source in a forward direction, the reflector having:

an upper end at which a first auxiliary reflective surface is formed; and a lower end at which a second auxiliary reflective surface is formed; and a bezel mounted in front of the reflector and having:

an upper part on which a first reflective hole that corresponds to the first auxiliary reflective surface is formed;

a lower part on which a second reflective hole that corresponds to the second auxiliary reflective surface is formed;

an upper lens provided on the first auxiliary reflective surface to form the first reflective hole between the bezel and the upper lens;

a lower lens provided on the second auxiliary reflective surface to form the second reflective hole between the bezel and the lower lens; and a side lens provided on a side surface of the bezel.

2. The head lamp apparatus for the vehicle according to claim 1, wherein the length of the second reflective hole between the bezel and the lower lens is larger than the length of the first reflective hole between the bezel and the upper lens.

3. The head lamp apparatus for the vehicle according to claim 1, wherein the first auxiliary reflective surface is larger than the second auxiliary reflective surface.

* * * * *